US006968871B2

(12) United States Patent
Bryan et al.

(10) Patent No.: US 6,968,871 B2
(45) **Date of Patent: *Nov. 29, 2005**

(54) HAZARDOUS MATERIALS TRANSFER SYSTEM AND METHOD

(75) Inventors: Avron I. Bryan, Cocoa Beach, FL (US); Robert D. Husband, Titusville, FL (US); Larry D. Heller, Osteen, FL (US)

(73) Assignee: Adapco, Inc., Sanford, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/752,214

(22) Filed: Jan. 6, 2004

(65) Prior Publication Data

US 2004/0194851 A1 Oct. 7, 2004

Related U.S. Application Data

(63) Continuation of application No. 10/032,367, filed on Dec. 18, 2001, now Pat. No. 6,698,461.

(60) Provisional application No. 60/256,718, filed on Dec. 19, 2000.

(51) Int. Cl.[7] ..... B65B 3/04

(52) U.S. Cl. ..... 141/94; 141/1; 141/95; 141/198

(58) Field of Search ..... 141/1, 4–9, 18, 141/37, 47, 49, 59, 65, 67, 83, 94, 95, 100, 141/101–105, 192, 198, 285

(56) References Cited

U.S. PATENT DOCUMENTS 5,749,402 A * 5/1998 Stotelmyer et al. ..... 141/83
6,360,793 B1 * 3/2002 Sugano et al. ..... 141/197
6,499,516 B2 * 12/2002 Pope et al. ..... 141/59

* cited by examiner

*Primary Examiner*—Timothy L. Maust
(74) *Attorney, Agent, or Firm*—Allen, Dyer, Doppelt, Milbrath & Gilchrist, P.A.

(57) ABSTRACT

A hazardous fluid materials transfer system is automated to control the transfer of the hazardous fluid while maintaining the fluid within a closed environment for providing maximum personal protection to the operators handling the hazardous materials during the transfer, such as those operations in the mosquito control industry. The system includes the transfer of the fluid to storage tanks intermediate the source and target tanks between the transfer is desired. A pre-programmed processor receiving pressure, weights, and connection signals from transducers, such as pressure sensors and load cells, located throughout the system controls the operation of pumps and valves to allow the fluid being transferred to remain within a closed environment.

15 Claims, 6 Drawing Sheets

3A 3B 3C 3A 3B 3C 3A 3B 3C

HAZARDOUS MATERIALS TRANSFER SYSTEM AND METHOD

CROSS-REFERENCE TO RELATED APPLICATIONS

This application is a continuation of U.S. application Ser. No. 10/032,367, filed Dec. 18, 2001, now U.S. Pat. No. 6,698,461 which claims the benefit of U.S. Provisional Application No. 60/256,718, filed Dec. 19, 2000, both of which are hereby incorporated herein in their entireties by reference.

FIELD OF THE INVENTION

The invention relates generally to the transfer of hazardous materials, and more particularly to a method of transferring hazardous materials within an environmentally closed system for protecting the health and well being of personnel responsible for the materials transfer.

BACKGROUND OF THE INVENTION

The transfer of hazardous materials is known to present potential problems to both the environment within which the hazardous materials are being used, and to the user responsible for handling the materials. There is a particular need to control such transfer of hazardous materials without an undue reliance on the skill or training of the personnel handling the materials. It would be preferable is such transfer could be an easy as filling ones gas tank at a self-service gas station, and in particular not require cumbersome and expensive protective wear. There is further a need handle such hazardous materials with a thought of protecting the environment.

SUMMARY OF THE INVENTION

The present invention, herein described and embodied in a chemical materials transfer system and method, includes an automated system useful in mosquito control, by way of example, for transferring hazardous chemicals from a chemical storage tank to a tank on board a vehicle or aircraft from which the chemicals will be distributed. The chemical materials transferred using the system and method of the present invention remain within a closed (gas sealed) environment in order to provide the maximum personal protection to the user during a transfer operation.

While not the same as filling ones automobile fuel tank with gasoline, operation of the system is intended to be as simple. However, embodiments of the present invention prevent the hazardous materials, both liquids and gases, from escaping into the environment. As a result, there is no need for personnel protective suits or re-breathing equipment, and the possible exposure to the chemical is still dramatically reduced. The present invention provides a capability to mix at varying ratios as well as safely transfer the hazardous material.

An automated system, as herein described by way of example, is useful for mosquito control personnel required to transfer and/or mix harsh chemical materials with a diluent from a chemical materials storage drum to a storage tank on board a vehicle or aircraft. The embodiment of the present invention herein described discloses a closed system for providing personal protection.

The present invention, a fluid materials transfer system useful for transferring hazardous fluids form a source to a target while maintaining the fluid materials within a closed environment in order to provide the maximum personal protection to the user during a transfer operation, comprises fluid storage means for storing a fluid within a closed environment, first flow control means operable with the fluid storage means for delivering a fluid from a source location thereto while maintaining the fluid within the closed environment, sensing means for sensing an amount of fluid carried by the storage means, second flow control means operable with the storage means for delivering the fluid therein to a target location while maintaining the fluid within the closed environment, and processing means operable with the first and second flow control means for controlling flows therewith in response to an amount of fluid sensed by the sensing means.

A method aspect of the invention includes transferring hazardous fluids from a source to a target while maintaining the fluid materials within a closed environment in order to provide the maximum personal protection to the user during a transfer operation comprising storing a fluid within a closed environment, delivering the fluid from the source location while maintaining the fluid within the closed environment, sensing an amount of fluid from the storing, delivering a controlled amount of the fluid to a target location while maintaining the fluid within the closed environment, and controlling the delivering of the fluid from the source location to the target location in response to the sensing of the amount of fluid being stored.

BRIEF DESCRIPTION OF THE DRAWINGS

Embodiments of the invention are described by way of example with reference to the accompanying drawings in which.

DETAILED DESCRIPTION OF THE PREFERRED EMBODIMENTS

The present invention will now be described more fully hereinafter with reference to the accompanying drawings, in which embodiments of the present invention are shown by way of illustration and example. This invention may, however, be embodied in many forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
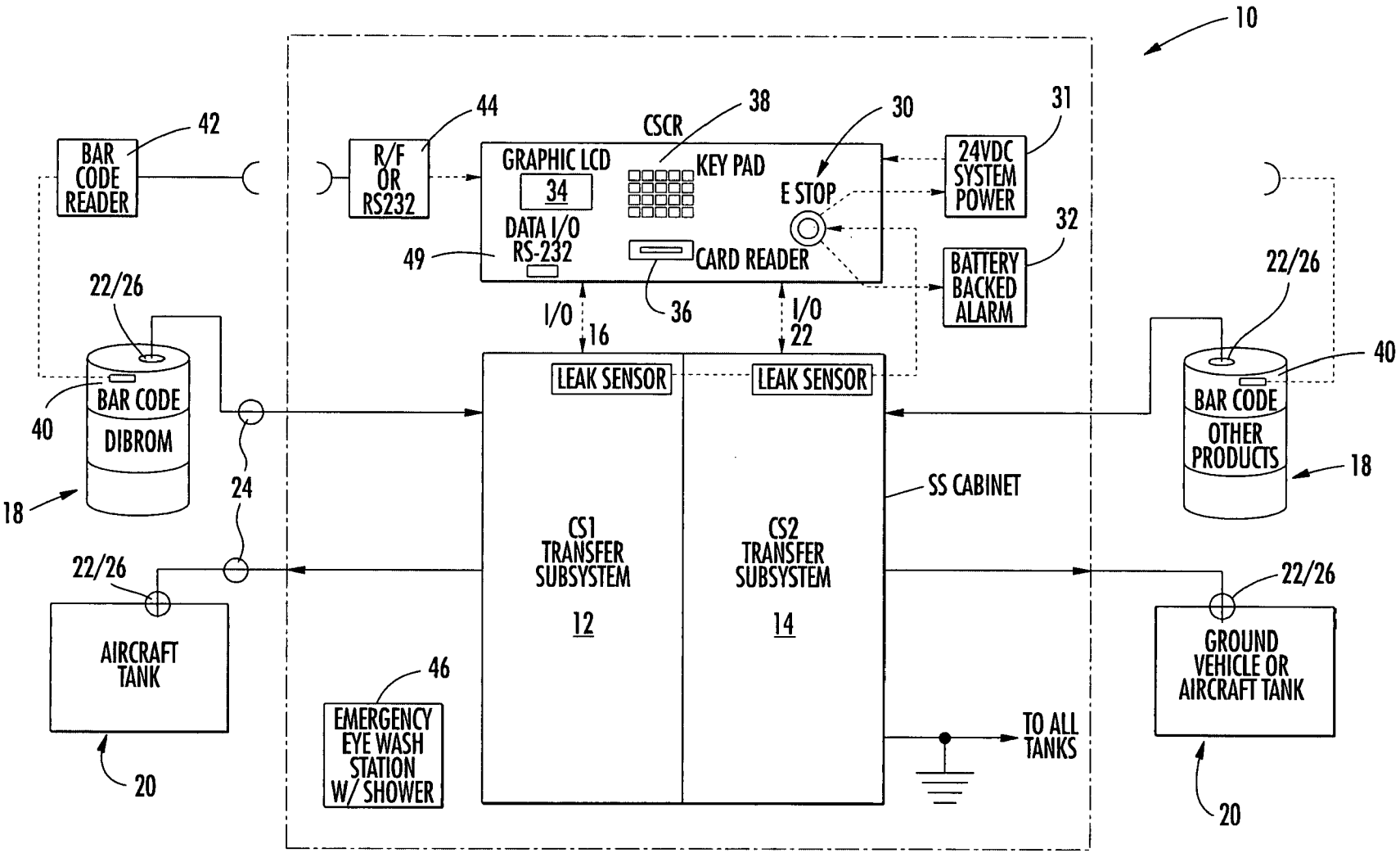
FIG. 1 is a block diagram illustrating an embodiment of the present invention including a closed system for the mixing and transfer of chemicals.

With reference initially to FIG. 1, the system 10 illustrative of the present invention and herein described by way of example, includes a first subsystem 12 for illustrating a transfer of a highly hazardous material such as Dibrom (dibromochloropropane—a colorless, halogenated, carcinogenic hydrocarbon used as a pesticide, fumigant, and nematocide, and restricted in usage), a second subsystem 14 for illustrating a mixing and transferring of environmentally harmful materials, by way of example, and a controller 16 operable with both subsystems for controlling the transfer of the materials to be handled and keeping a record thereof. Expanded details of each will be addressed with reference to FIGS. 2–4. It is expected that the first subsystem (CS1) 12 will use Teflon fittings and other special processing components (pumps and valves) to handle the Dibrom product. The second subsystem (CS2) 14 will have additional components to provide for the mixing process with oil or water as may be required by the particular chemical material for the pre-selected use.

With continued reference to FIG. 1, consider the mechanical aspects of the present invention with reference to those needs known in the mosquito control industry. The embodiments illustrated with reference to the accompanying drawings accommodate the transfer of chemical materials from source tanks 18 such as 30, 55, or 275-gallon drums or bulk containers. Elements herein described for the embodiments illustrated, such as closed connectors may be selected from trusted and reliable manufacturers, and are herein presented are for illustrative purposes. Continuing with the example for mosquito control, a target tank 20 in the transfer may include a chemical container to be transported onboard a vehicle, such as a pickup truck, which truck may be part of the system of the present invention. This target tank 20 will likely have a 15–20 gallon capacity, be UV resistant, and preferably be manufactured from a high-density polyethylene. Typically, larger containers will the target tank 20 when used on an aircraft from which the chemical will be spread.

Some chemical materials (chemicals) planned for use may require mixing with a diluent, such as a light oil or water. Mixing ratios may typically range from 4:1 to approximately 15:1 and may be either mechanically adjusted or logic controlled. Generally, most chemicals used in mosquito control will not require mixing and are known generally known as ready-to-use (RTU) chemicals. As will be described in more detail later in this section, a connector 22 on a vehicle container will be sealed while connected or unconnected to any supply line 24. The connector 26 on the supply line 24 is also sealed to prevent leaks while unconnected. As is described more fully with reference to FIGS. 2 and 3A, 3B, and 3C, the supply hose 28 connected to the vehicle is preferably not pressurized while not in use. Transfer times may range from approximately 5 gallons per minute for ground vehicles to about 20 gallons per minute for aircraft. Any system component contacting the chemical must be compatible with the harsh, corrosive mosquito control chemicals, such as Dibrom, by way of example. A Material Safety Data Sheet (MSDS) for Dibrom will be provided as well as material compatibility from AMVAC, the manufacturer of the chemical. Baytex and Fyfanon are other chemicals known to be corrosive and hazardous, thus requiring care when handling. The system 10 will automatically stop the transfer of the chemical materials when the target tank 20 is full. The system 10 as illustrated with reference again to FIG. 1, with further details illustrated in FIG. 4, includes a manually operated emergency stop button 30 which when activated will cause an override any automatically operated stop or start control. The emergency stop button 30 for the transfer process is mounted on a user interface panel of the controller 16. The stop button removes the 24 volt system power 31 supplied, thus stopping all operations after emergency stop flow valves have been activated, which valves are described later in further detail with reference to FIGS. 2 and 3A, 3B, and 3C. The system 10 will capture or re-circulate any vapor generated by the chemical materials during transfer. Also, an alarm 48 is activated which is separately battery powered.

With reference again to FIG. 1 and specifically the controller 16, consider the intelligence and control aspects of the present invention. The system 10 controls flow of the chemical materials and meters its presence within a closed loop. The controller 16 controls and records the operation and data collection for both the first subsystem (CS1) 12 and the second subsystem (CS2) 14. Individually controlled operation is preferred, but the system 10 and its controller 16 may not be limited to an individual or a simultaneous control of both subsystems, which control will depend on the operation and the support personal. Therefore, one subsystem, dual subsystems, two distinct subsystems, or any combination will be selected by a used to meet the need.

By way of example, the metering method as herein described includes use of weighing devices such as load cells 33, as will be further described and illustrated with reference to FIGS. 2 and 3A, 3B, and 3C, but it is expected that other methods and devices, such as in-line metering will be used by those of skill in the art now having the benefit of the teachings of the present invention. Flow data is stored in a computer memory, and data reporting may include but is not limited to total chemical material per vehicle, date and time chemical material was transferred, person performing the transfer, vehicle number, type of chemical material transferred, total amount of chemical material used per day, and the cumulative total. A graphic display 34 is provided. Password entry or card reader 36 data entry will be required for access to the controls. In addition, a keypad 38 is provided for data entry for the embodiment herein described. Desired amounts of material to be transferred will be programmed, and an automatic shut-off provided as an override. The graphic (LCD) display 34 and the keypad 38 to enable user commands to the system 10 and the ability to view data relating to the transfer process. Reports on the transfer process are available via an RS232 connection port either in real-time or as a call up report.

As above described, the present invention provides for chemical materials transfer while providing personnel and environmental protection. As herein presented, by way of example, for the hazardous material Dibrom, and for certain other mosquito insecticide materials, the standalone first subsystem (CS1) 12 may be required, and will need to be dedicated to that specific chemical material or product throughout its use, or until thoroughly cleaned. With such a requirement, a separate standalone subsystem, such as the second subsystem (CS2) 14 will be used to transfer, or mix and transfer, all other chemical materials for the mosquito insecticides anticipated for the example herein described. Again, it is anticipated that various alternatives, combinations and sub-combinations of the embodiments herein presented by way of example, will be developed now having the benefit of the teachings of the present invention.

With reference again to FIG. 1, the source tanks 18 carrying a supply of insecticide carry a bar code ID strip 40. The bar code strip 40 is read by a bar code reader 42, which also transmits the data to the controller 16 via an RF signaling unit 44. This will permit identifying that the source (supply) tank 18 is carrying an acceptable product. The controller algorithm will utilize known bar code data provided by a supplier, a customer identification number, and chemical utilization data for the particular source tank to qualify that source tank as being acceptable for use. Provisions for the bar code reader 42 are included in the controller 16. As a further safety consideration, a shower and eye wash station 46 is provided as a part of the system 10. An RS232 connection 48 is also used as will be described later in further detail.

The controller 16 includes numerous inputs and outputs (I/O) to each subsystem 12, 14 for an operator interface, the bar code reader 42 and the RS-232 serial port 49. By way of example, the second subsystem 14 illustrated with reference to FIGS. 3A, 3B, and 3C, will have I/O which will include: six 4–20 mA inputs from the load cell summations, differential pressure sensor, and the pressure transducer to the A/D on the system; two pulse width modulated (PWM) signals at 24 volts from the system 14 to pumps P2 and P4 pumps; and two logic 5 volt signals to the controller 16; and ten 24 volt control commands from the controller 16 to the subsystem 14.

The first subsystem 12 will have direct I/O which include: two 4–20 mA inputs from the load cell summations, pressure transducer to an A/D converter for the controller 16; one 24 volt PWM signal to a pump (P2); three logic 5 volt signals to the controller 16; and six 24 volt control signal commands from the controller 16 to the first subsystem (CS1) 12.

With reference again to FIG. 4, and by way of example, a processor 17, including a TDS2020 and a Mother Board with I2C paths can satisfy these I/O requirements. Therefore, while one may prefer using a dual TDS2020 implementation based on desired control, one is probably not required.

Consider the operation of the first subsystem 12 with reference again to FIG. 2. The chemical material being used is Dibrom, a corrosive insecticide in a liquid form carried in the source tank 18. A dry connector (manufactured by Micro-Matic) is used for the connection 22/26, as earlier described with reference to FIG. 1, to this mosquito control chemical source. The chemical material transfer flow process is automatic and is controlled by the controller 16, after the desired start data have been entered through the keypad 38, by way of example. Transfer process feedback is achieved by reading data from the sensors and process hardware control is via on/off switches at 5 volts, 24 volts or PWM signals to pumps, as illustrated with reference to FIG. 4.

Figure 2:
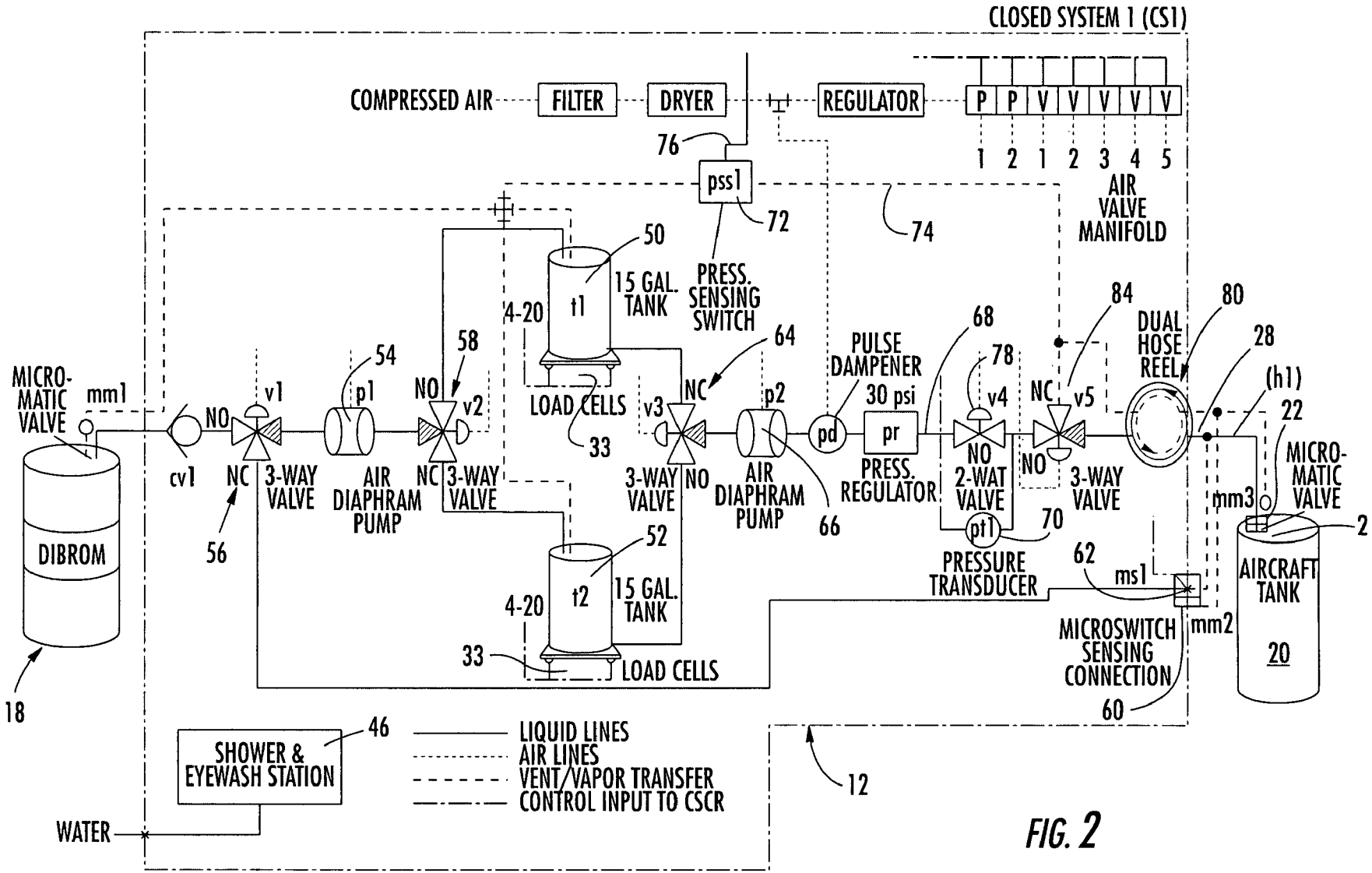
FIG. 2 is a block diagram of an embodiment of the present invention illustrating elements used for transfer of a hazardous chemical material from a source to a target tank.
Figure 4:
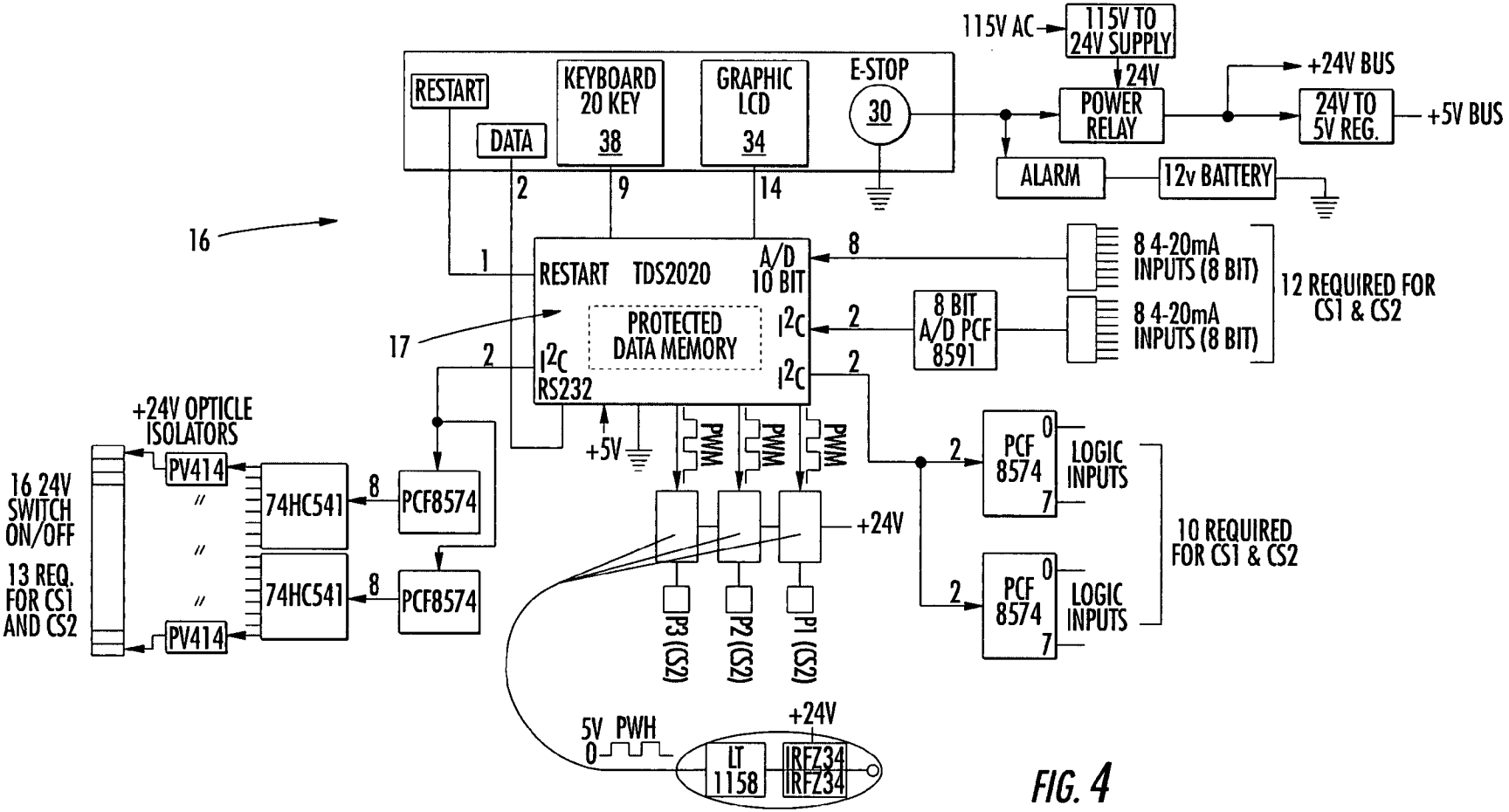
FIG. 4 is a block diagram illustrating one system controller operable with the embodiments of FIGS. 1–3.

The measurement accuracy of the total chemical transferred will depend upon the accuracy of the load cells 33 on the first and second tanks 50, 52 (also identified in FIG. 2 as t1 and t2). The error in measurement will be less than 2%. The transfer of chemical materials using the first subsystem 12 will assume that the requirement includes transferring the Dibrom from the source tank 18 to the target tank 20 without a need for mixing, unlike the example described with reference to FIG. 4 illustrating the second subsystem 14. The sequential process steps for the insecticide chemical transfer from the source tank 18 to the target tank 20 located on an aircraft will be as follows:

The controller 16 described earlier with reference to FIGS. 1 and 4, verifies at an initial time (time #0) that the first tank (t1) 50 and the second tank (t2) 52 are at a "full" level. If the first tank 50 is not full, a first pump (p1) 54 is switched on. If the first tank 50 is such that its level does not increase, a message is displayed with instruction to change the source tank 18. If the first tank 50 is full but the second tank 52 is not, a diverter styled valve (v1), a first valve 56 is held in its normally open (NO) position allowing the first pump 54 to be switched on for filling the second tank 52 through the normally open second diverter valve (v2) 58. If the fluid level in the second tank 52 still does not increase, a message is again displayed to change source tank 18.

The controller 16 verifies at a later time (time #1) that the supply hose 24 at location (h1) is attached to a receptacle/connector 60 by checking the status of micro switch (ms1) 62. The micro switch 62 must be closed to begin user keypad interface operation. The controller 16 will switch valve (v3) 64 allow flow to the first tank 50 and the first valve 56 and the first pump (p1) 54 and second pump (p2) 66 to wet the system flow lines 68 to be ready for connection to the target tank 20.

After a predetermined wetting time, the first valve (v1) 56 is turned off and pressure is delivered to the system lines 68 until it is measured at approximately 30 PSI, by way of example, and indicated by a signal from a pressure transducer (pt1) 70. The controller 16 will then turn off the first valve 56 and the first (p1) and second (p2) pumps 54, 66.

The controller 16 will then display a message to disconnect the hose 28 at the connector (mm2) 60 and connect the hose connector 22 to the target tank connector (mm3) 26.

Once the hose 28 is connected at (mm3) to the target tank 20, the controller will sense a pressure drop at the transducer (pt1) 70 indicating that the system line 68 has been connected. The transfer and filling process can then start.

The controller 16 then takes the preset conditions (GPM and pre-programmed total), initiating the fill cycle.

During this fill cycle, the material/product (e.g. Dibrom) is first transferred from the first tank 50 (t1) to the target tank 20. If more product is needed to complete the fill cycle, flow from the second tank 52 (t2) will be switched by the controller 16 using the third switching valve 64 (v3) to the second tank (t2) and refilling the first tank (t1) by second switching valve 58 (v2) to the first tank 50 (t1) and also turning on the first pump 54 (p1). The controller 16 will check the weight of the first tank 50 using a signal from the load cell 33 until a full condition indication has been met. The controller will then turn the first pump 54 (p1) off, while metering the output of the second tank 52 (t2) using its associated load cell 33, or alternatively by using a flow metering device. If more material is required to complete the filling of the target tank 20, this step is repeated with a toggling between the first and second tanks.

The controller 16 will transfer a pre-programmed quantity of product (Dibrom) to the target tank 20. If the target tank 20 becomes full before the pre-programmed amount, pressure in the target tank will be sensed by a pressure sensing switch (pss1) 72 operable within vent/vapor line 74 of the system 10 for providing a pressure signal to the controller 16 via control input lines 76 lines operable with the controller indicating that the second pump 66 must be turned off and a two-way valve (v4) 78 closed. By way of example, when filling is within 2 gallons of the pre-programmed amount, the controller 16 will taper (slow) the rate of the second pump (p2) 66 output until a desired amount is reached. During the transfer and filling operation, vapor from the target tank 20 is transferred back to the source tank 18 via the line 74 to keep the system 10 closed to the surrounding/outside environment.

Should an emergency condition exist, pressing the large emergency stop button 30 will immediately close the two-way valve (v4) 78 and all operating system components. To restart the system, the emergency stop button 30 must be manually reset as will be indicated by a message from the controller 16.

Operation includes draining the hose 28. Upon completion of the filling of the target tank 20, the controller 16 will display a message "do you want to fill another tank". If your keypad entry is a "no," the controller 16 will display a message to disconnect the connectors 22/26 (mm3) from the target tank 20, retract the hose 28 on its hose reel 80 and connect the hose connector 26 to the connector/receptacle 60 (mm2). If your answer and keypad entry id a "yes," the controller 16 will display message to disconnect connectors 22/26 (mm3) from the target tank 20, retract the hose 28 on the reel 80 to prevent damage to the hose and connector 26, and do not reconnect to the receptacle 60 (mm2). This will leave the system lines 68 wet for filling additional target tanks.

When connecting to (mm2) 60 after filling has been completed, the controller 16 will sense a signal from a micro switch (ms1) 82 indicating a closure and thus indicating that the hose 28 is connected. The controller 16 will then open a fifth valve (v5) 84 (a three-way valve) to provide air into the fluid system lines 68 to prevent hose collapse during drainage. In addition to opening the fifth valve 84(v5), the controller 16 will open the first valve (v1) 56, close the two-way valve (v4) 78 and turn on the first pump (p1) 54. The controller will then make a determination as to which tank, the first(t1) or the second (t2) is to be used for draining the hose 28 and will position the second valve (v2) 58 accordingly for draining the hose based on which tank is less full. This operation will continue until no further material/product is pumped into one of these two tanks as sensed by the corresponding load cells 33.

The last step in this sequence to be performed is to fill both the first (t1) and second (t2) tanks 50, 52. After this final sequence is complete, the computer TDS2020 will go into "sleep mode" after a predetermined time period.

By way of further example and use of alternate embodiments of the present invention, consider an operation of the second subsystem 14 with reference again to FIG. 3 for a use of the invention in mixing and transferring chemical materials within a closed system 11. In the example herein described, liquid inputs to the system 11 are an insecticide chemical carried within the source tank 18 and a dilution chemical, either oil or water (if dilution is required) carried within the dilution tank 86. As earlier described with reference to FIG. 1, dry connectors 22, 26 are used on the source tank 18 with the mosquito chemical.

As earlier described with reference to FIGS. 1 and 2, the chemical materials transfer flow process is automatic and controlled by the controller 16 (after the necessary start data has been entered at the keypad 38). Process feedback is achieved by reading data from the various system sensors and process hardware control is via on/off switches at 5 volts and 24 volts or PWM signals (24 volt) to system pumps. The accuracy of the materials mixing is dependent upon the accuracy of the load cells 33 used. It is expected to be within better than 2%.

The transfer of chemical material from the source tank 18 to the target tank 20 including mixing of the chemical material with a diluent transferred form the dilution tank 86 will assume that a particular mixing of the insecticide and dilution chemical is required. One preferred embodiment of the present invention includes the following sequential process steps for this insecticide chemical transfer from the source tank 18 to the target tank 20, some of which steps may be eliminated depending upon the requirements imposed by the chemicals being transferred and the desires of the user.

As way similarly described for the operation of system 10, with reference to FIG. 2, the controller 18 verifies at an initial time (time #0) that the tank (t1) 50*c* and the tank (t2) 52*c* levels are full. If tank (t1) 50*c* is not full, pump (p1) 54*c* is switched on. If tank (t1) 50*c* levels still do not increase, a message is displayed to change the source tank 18. If tank (t1) 50*c* is full but tank (t2) 52*c* is not, valve (v1) 58*c* and pump (p1) 54*c* are both switched on until a full condition is indicated. If tank (t2) 52*c* levels still do not increase, a message is again displayed to change the source tank 18.

If mixing with a dilution chemical is not required, the controller 16 will not attempt to fill tank (t3) 50*d* and tank (t4) 52*d*. If mixing is required, the controller 16 will also verify at time (time #0) that tank (t3) 50*d* and tank (t4) 52*d* levels are full. If tank (t3) 50*d* is not full, pump (p3) 54*d* is switched on. If tank (t3) 50*d* levels still do not increase, a message is displayed to change the dilution tank 86. If tank (t3) 50*d* is full but tank (t4) 52*d* is not, valve (v4) 58*d* and pump (p3) 54*d* are both switched on until the controller 16 receives a sensing signal indicating a full condition. If tank (t4) 52*d* levels do not rise at any time during this sequence, a message is displayed to change the dilution tank 86.

The controller 16 verifies at time (time#1) that the hose (h1) 28 is attached to the receptacle (mm2) 60, as earlier described with reference to FIG. 2, by checking the status of micro switch (ms1) 62, which micro switch (ms1) must be closed to begin user keypad interface operation. The controller 16 will switch on valve (v2) 64*c* and valve (v5) 64*d* as well as pumps (p2) 66*c* and (p4) 66*d* at preferably low flow rates, and switch a transfer pump (p5) 88 on and off until a fifth tank (t5) 90 within this mixing system 11 is full. A tank level sensor (tsf) 92 signals the controller 16 that the tank (t5) 90 is full. The controller 16 will then turn off pump (p5) 88 and close a valve (v9) 94 located between the tank 90 and the pump 88 connected to the receptacle/connector 60. The controller will then turn off pump (p2) 66*c* & pump (p4) 66*d* when a pressure transducer (pt1) operable within the system line indicates 30 PSI. This sequence indicates that the system 11 is within a wet condition.

The controller 16 will then display a message to disconnect the hose (h1) 28 at the connector (mm2) 60 and connect the hose connector 26 to the target tank connector (mm3) 22.

Once the hose 28 has been connected using the connectors (mm3) 22/26 to the target tank 20, the controller 16 will receive a signal from the pressure sensor indicating a pressure drop at (pt1) indicating that the system 11 is closed, properly connected, and ready to start the filling process.

The controller 16 will now take the preset conditions and programmed requirements (GPM, mix ratio, pre-programmed total, and the like) and will initiate the transfer and filling cycle.

In the way of providing further example with regard to using the system 11 without mixing, such as is known for RTU products, the controller 16 will first open valve (v6) 98, close valve (v5) 64*d* and turn on pump (p4) 66*d* until a tank level empty signal from level sensor (tse) 100 is indicated in tank (t5) 90. In this embodiment, once the +5 volt signal has been sensed from the (tse) sensor 100, the controller 16 will close valve (v6) 98, and turn off pump (p4) 66*d*. During this fill cycle, product is transferred from tank (t1) 50*c* first to the target tank 20. The controller 16 will turn on pump (p2) 66*c* and open valve (v2) 64*c*. If additional product is needed to complete the filling cycle, and tank (t1) 50*c* is empty, tank (t2) 52*c* will be used by the controller 16 switching valve (v2) 64*c* to tank (t2) 52*c* and valve (v1) 58*c* and pump (p1) 54*c* to refill tank (t1) 50*c*. The controller 16 will check the weight of tank (t1) 50*c* until a full indication has been met, then turn pump (p1) 54*c* off, while metering the output of tank (t2) 52*c*. If yet additional product is required to complete the filling of the target tank 20, this step is repeated, toggling between the two tanks 50*c*, 52*c*.

Consider the mixing of the chemical material with diluent, keeping in mind that while a liquid is used herein by way of example for the mosquito control industry, it is anticipated that any fluid, including beads by way of example, may be used in the transfer now having the benefit of the teachings of the present invention. This step including a mixing is as previously described except that both are accomplished simultaneously. It is to be noted that when a three-way manually operated valve, valve (v3) 102 is used to select between oil or water dilutions, the controller 16 will display a message to check the manual position of this valve accordingly. This sequence will be the same as that described for the RTU but with different components designated to complete the task, as will herein be described. The controller 16 must first open valve (v6) 98, close valve (v5) 64*d* and turn on pump (p4) 66*d* until a tank level empty (tse) is indicated for tank (t5) 90. Once the +5 volt signal has been sensed from the (tse) sensor 100, valve (v6) 98 is closed and valve (v5) 64*d* is opened. During this cycle, product is first transferred from tank (t3) 50*d* to the target tank 20. The controller 16 will turn on pump (p4) 66*d* and open valve (v5) 64*d*. If additional product is needed to complete the transfer and fill cycle and tank (t3) 50*d* is empty, the controller 16 will switch operation to tank (t4) 52*d* by switching valve (v5) 64*d* to tank (t4) 52*d*, valve (v4) 58*d* to tank (t3) 50*d*, and pump (p3) 54*d* to be used to refill tank (t3). Using a signal from the appropriate load cell 33, the controller 16 will check the weight of tank (t3) 50*d* until a full indication has been met, then turn pump (p3) 54*d* off, while metering the output of tank (t4) 52*d*. If yet additional product is required to complete the filling of the target tank 20, this step is repeated, toggling between the two tanks 50*d*, 52*d*. It should be herein that the use of a pair of tanks 50, 52 described with reference to FIG. 2, and tank pairs 50*c*, 52*c* and 50*d*, 52*d* may each be replaced by single larger capacity tank. However, the use of tank pairs minimizes the need for the large volume subsystems 12, 14 by toggling between the tanks within the tank pairs. Further, it should be appreciated based on the teachings of the present invention, that the tank pairs in combination with the associated load cells combine to provide a measure of flow and flow rate. Alternatively, flow meters may be used.

In the mixing cycle of the embodiment of the system 11 herein described by way of example, the controller 16 controls the mixing ratio of pump (p2) 66*c* and pump (P4) 66*d* with the output going through a mechanical mixer (m1) 104 through additional valves and hose 28, which hose is conveniently carried on a reel 80, as earlier described with reference to FIG. 2, and out to the target tank 20.

Again, if an emergency condition exists, pressing the large red emergency stop button 30 illustrated with reference again to FIGS. 1 and 4, will immediately close valve (v7) 106 positioned intermediate to the mixer 104 and target tank 20, as illustrated in FIG. 3. In addition, the system operation will be turned off. In order to restart the system, the emergency stop button 30 must be manually reset as is indicated by an automatically displayed message from the controller 16.

The system 11, as performed by the controller 16, will transfer a predetermined and pre-programmed quantity of product to the target tank 20. If the target tank 20 becomes full before the pre-programmed amount has been reached, pressure in target tank 20 will be sensed by a pressure sensing switch (pss1) 108 communicating with the controller 16 indicating that pumps (p2 and p4) 66*c*, 66*d* need to be turned off, valve (v7) 106 is to be closed. Preferably, when filling within approximately 2 gallons of the pre-programmed amount, the controller 16 will taper (slow down) the flow rates and thus outputs of pumps (p2 and p4) 66*c*, 66*d* until the desired amount is reached.

During the filling operation, vapor from the target tank 20 is transferred back to the source tank 18 to keep the system 11 closed to the surrounding environment. Venting the vapor back to the source tank 18 is accomplished by monitoring pressure in the source tank using the pressure sensing switch (pss2) 110 until reaching approximately 3 to 5 PSI, which will supply a +5 volt signal to the controller 16, resulting in the controller in turn closing solenoid valve (v10) 112 to divert vapor through a carbon filter 114, and out to the surrounding environment if appropriate for the chemical materials being transferred.

Once the transfer operation is completed, it is desirable to drain the hose 28. Upon completion of the filling of the target tank 20, the controller 16 will display a message such as "do you want to fill another tank". If the answer is "no," the controller will display a message to disconnect the connectors (mm3) 22, 26 from the target tank 20, retract the hose 28 onto the reel 80 and connect the hose connector 26 to the receptacle/connector (mm2) 60. If the answer is "yes," the controller 16 will display a message to disconnect (mm3) 22, 26 from the target tank 20, retract the hose 28 onto the reel 80 to prevent damage to hose and connector, and do not reconnect to (mm2) 60. This will leave the lines of the system 11 wet for filling additional tanks.

Figure 3A:
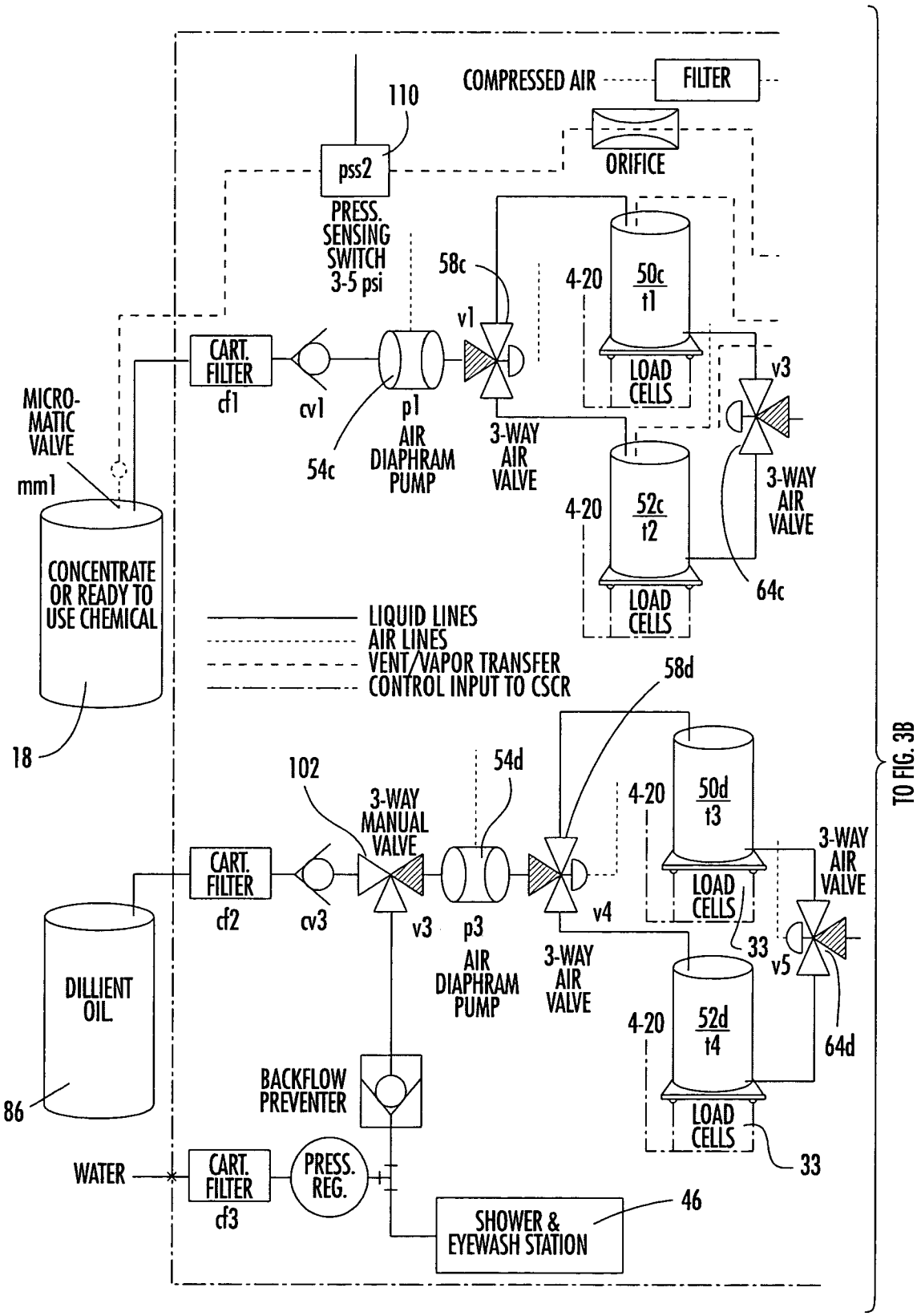
FIGS. 3A, 3B, and 3C present a block diagram of an embodiment of the present invention illustrating elements used for mixing and transfer of multiple chemicals from source to target tanks.
Figure 3B:
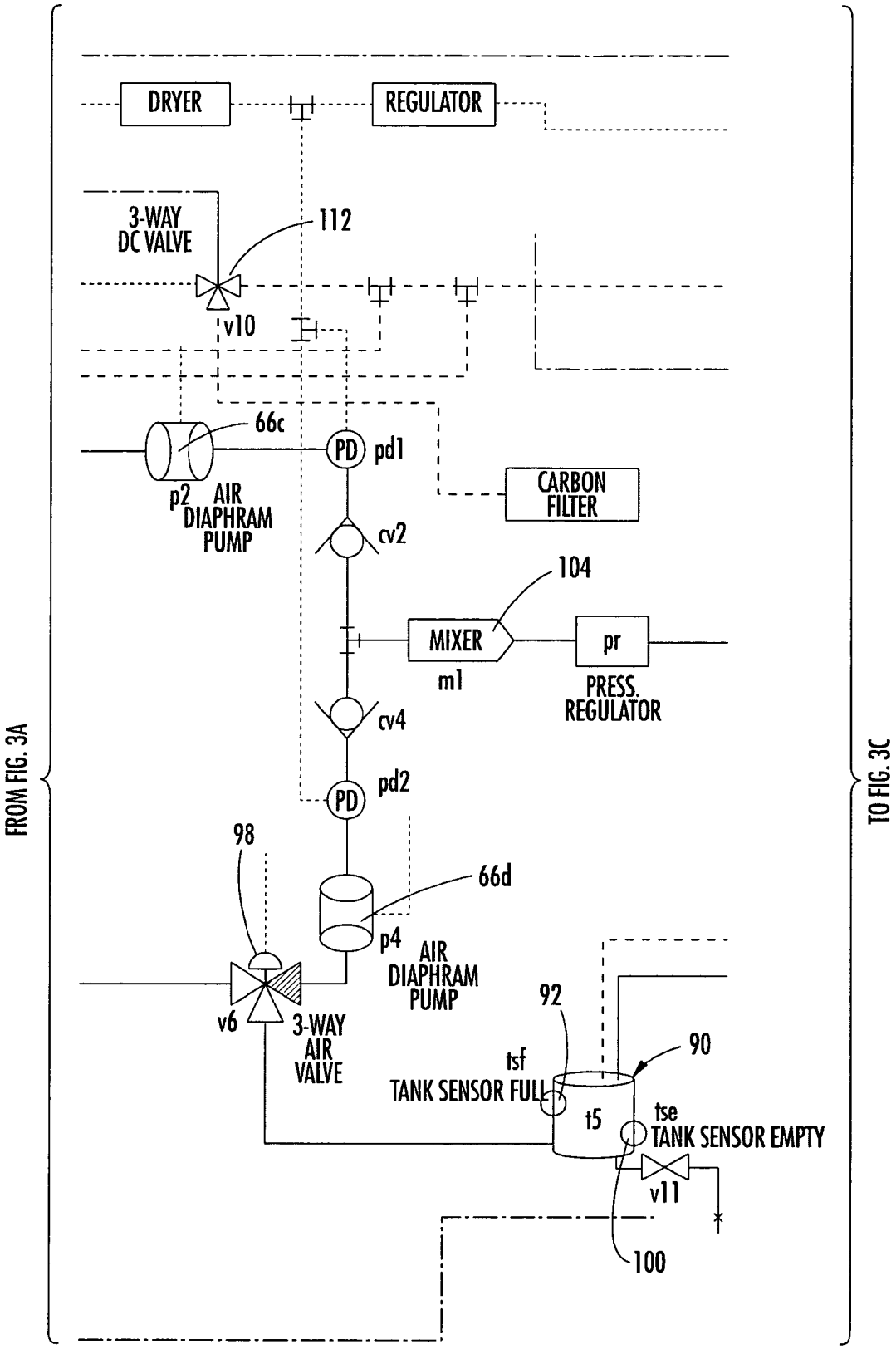
Figure 3C:
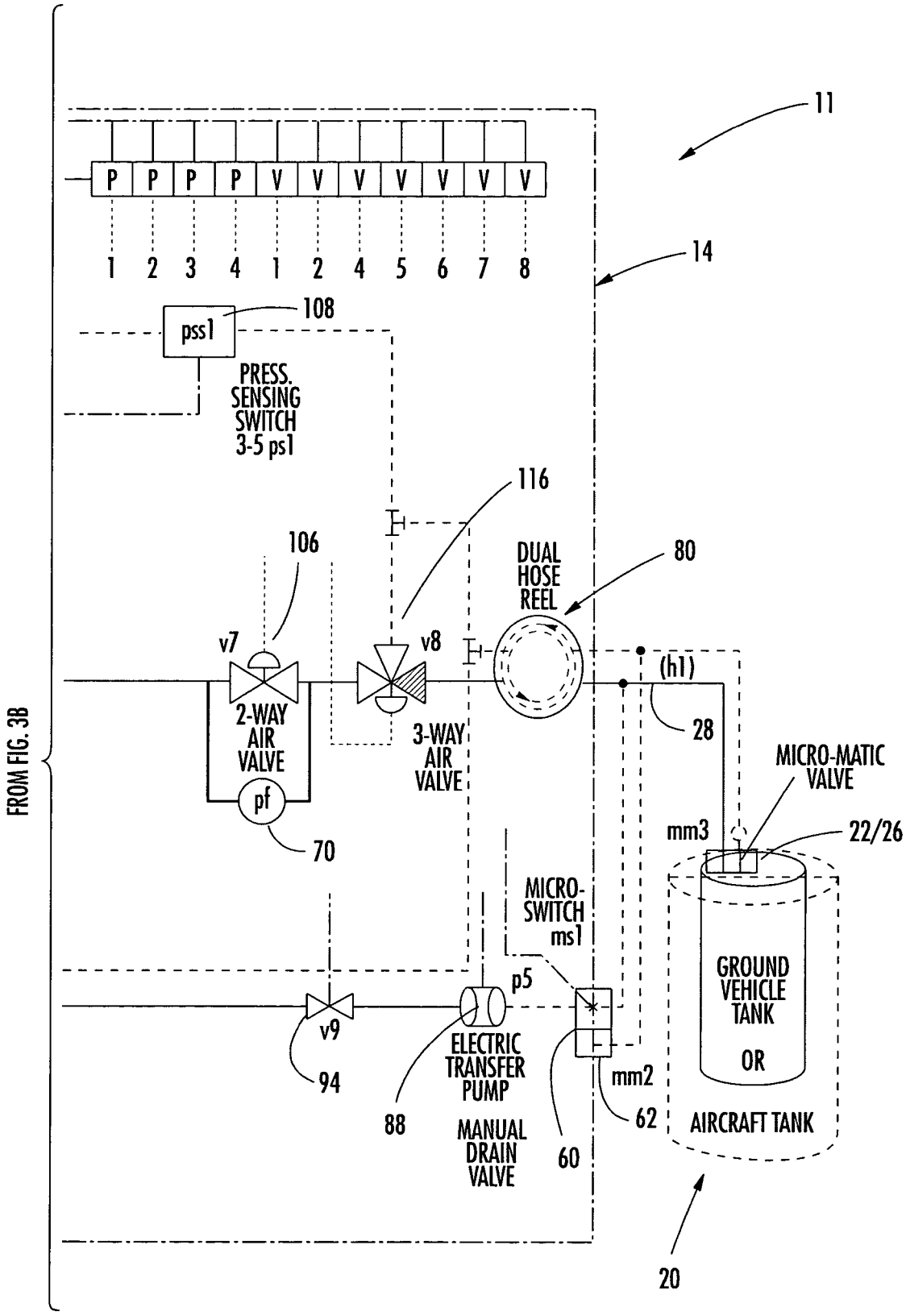

With continued reference to FIGS. 3A, 3B, and 3C, when connecting to receptacle/connector (mm2) 60 after filling has completed, the controller 16 receives a sensed signal from the micro switch (ms1) 62 indicating a closure and that the hose (h1) 28 is connected to the system 11. The controller 16 will then open a three-way valve (v8) 116 located inline between the two-way valve (v7) 106 and the exit portion of the hose 28, close valve (v7) 106 and turn on pump (p5) 88. This sequence will continue until the tank empty sensor (tse) 100 indicates a condition other than empty, plus a predetermined time, but not a full indication signaled by the sensor (tsf) 92.

The last sequence to be performed will be to fill tanks (t1 & t2) 50*c*, 52*c*, and (t3 & t4) 50*d*, 52*d* if applicable. After this final sequence is complete, the processor 17 (TDS2020) as earlier described with reference to FIGS. 1 and 4, will place the system into a "sleep mode" after a predetermined time period.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

That which is claimed is:

1. A fluid transfer system useful for transferring hazardous fluids within a closed environment, the system comprising:

fluid storage means for storing a fluid within a closed environment;

first flow control means operable with the fluid storage means for delivering a fluid from a source location thereto while maintaining the fluid within the closed environment;

sensing means for sensing an amount of fluid carried by the fluid storage means, wherein the sensing means comprises a pressure sensor operable for sensing pressure responsive to the fluid received by the fluid storage means;

second flow control means operable with the fluid storage means for delivering the fluid therein to a target location while maintaining the fluid within the closed environment;

a vapor line in fluid communication between the target location and the source location for transferring vapor from the target location to the source location within the closed environment and responsive to the target location receiving the fluid; and processing means operable with the first and second flow control means for controlling fluid flows therewith in response to an amount of fluid sensed by the sensing means.

2. A system according to claim 1, wherein the sensing means comprises a load cell operable with the fluid storage means for determining an amount of the fluid carried therein.

3. A fluid materials transfer system for transferring a hazardous fluid from a source to a target while maintaining the hazardous fluid within a closed environment in order to provide maximum personal protection to an operator during a transfer operation, the system comprising:

a source of hazardous fluid;

a target for receiving the hazardous fluid;

a conduit connected between the source and the target for maintaining the hazard fluid within a closed environment;

a pump operable for transferring the hazardous fluid from the source to the target;

a sensor in fluid communication with the conduit for sensing an amount of fluid transferred from the source to the target, wherein the sensor is operable for sensing a pressure at the target; and a controller responsive to the sensor for controlling the amount of fluid transferred to the target while maintaining the fluid within the closed environment, wherein the hazardous fluid comprises vapor being transferred from the target to the source within the closed environment, and wherein the controller stops the vapor from being transferred in response to a pressure limit at the target detected by the sensor.

4. A system according to claim 3, wherein the hazardous fluid comprises a carcinogenic hydrocarbon useful in at least one of a pesticide, fumigant, and nematocide.

5. A system according to claim 3, wherein the sensor is operable for sensing an amount of hazardous fluid transferred from the source.

6. A fluid transfer system comprising:

a first source of a first fluid;

a second source of a second fluid;

a target for receiving the first and second fluids;

a first conduit connected between the first source and the target for maintaining the first fluid within a closed environment;

a first pump operable for transferring the first fluid from the first source to the target;

a first sensor in fluid communication with the first conduit for sensing an amount of the first fluid transferred from the first source to the target;

a second conduit connected between the second source and the target;

a second pump operable for transferring the second fluid from the second source to the target; and a second sensor in fluid communication with the second conduit for sensing an amount of the second fluid transferred from the second source to the target; and a controller communicating with the first and second pumps and responsive to the first and second sensors for controlling the amount of fluid transferred to the target, wherein a pressure is sensed for determining an amount of both the first and second fluids being transferred.

7. A system according to claim 6, wherein the first conduit comprises a vapor transfer line and a liquid line, and wherein each of the vapor and liquid lines are connected at one end to the first source through a first micro-matic valve and at an opposing end to the target through a second micro-matic valve.

8. A system according to claim 6, further comprising a mixer connected to the first and second conduits at an entrance end and to the target at a exit end.

9. A system according to claim 8, wherein the controller is preset for providing a stop action to at least one of the first and second pumps, and thus the transferring of at least one of the first and second fluids for preset conditions selected from operational input requirements including at least one of flow rate, mixing ratio for mixing the first and second fluids, and total amount of the fluids to be transferred.

10. A system according to claim 6, wherein at least one of the first and second fluids is a hazardous fluid.

11. A system according to claim 6, further comprising:

a first container in fluid connection between the first source and the target for receiving the first fluid therein;

a first load cell operable with the first container for determining an amount of the first fluid carried therein;

a second container in fluid connection between the second source and the target; and a second load cell operable with the second container for determining an amount of the second fluid carried therein, wherein the sensor is operable with the first and second load cells for determining the amount of the first and second fluids contained therein.

12. A system for transferring a hazardous fluid from a source to a target while maintaining the hazardous fluid within a closed environment, the system comprising:

a source of hazardous fluid;

a target for receiving the hazardous fluid;

at least one container in fluid communication with the source and the target for receiving the hazardous fluid therein prior to being pumped to the target;

a load cell operable with the at least one container for determining an amount of the hazardous fluid carried therein;

at least one pump for pumping the hazardous fluid from the source to the target;

a sensor operable for sensing pressure at the target;

fluid flow control means communicating with the sensor for controlling fluid flow from the source to the target responsive to the pressure at the target; and a vapor line in fluid communication between the target and the source for transferring vapor from the target to the source within the closed environment responsive to the target receiving the hazardous fluid and increasing the pressure therefor.

13. A system according to claim 12, wherein the at least one pump comprises:

a first pump operable for pumping the hazardous fluid from the source to the container responsive to the amount of hazardous fluid carried therein; and a second pump operable for pumping the hazardous fluid from the container to the target responsive to the pressure at the target.

14. A system according to claim 13, wherein the at least one container comprises first and second containers operable with the second pumps for transferring the hazardous fluid therefrom.

15. A system transferring a hazardous fluid, the system comprising:

a source of hazardous fluid;

a target for receiving the hazardous fluid;

a conduit in fluid connection between the source and the target for maintaining the hazardous fluid within a closed environment;

a pump operable with the conduit for pumping the hazardous fluid from the source to the target;

a pressure sensor operable for sensing pressure at the target responsive to the hazardous fluid received thereby;

a controller responsive to the pressure sensor and communicating with the pump for controlling a pumping of the hazardous fluid to the target in response to the pressure at the target; and a vapor line in fluid communication between the target and the source for transferring vapor from the target to the source within the closed environment responsive to the target receiving the hazardous fluid.

* * * * *